US007270502B2

(12) United States Patent
Brown

(10) Patent No.: US 7,270,502 B2
(45) Date of Patent: Sep. 18, 2007

(54) STABILIZED EARTH STRUCTURE REINFORCING ELEMENTS

(76) Inventor: Richard Brown, 13453 County Rd. 1, Fairhope, AL (US) 36532

( * ) Notice: Subject to any disclaimer, the term of this patent is extended or adjusted under 35 U.S.C. 154(b) by 0 days.

(21) Appl. No.: 11/038,760

(22) Filed: Jan. 19, 2005

(65) Prior Publication Data

US 2007/0014638 A1 Jan. 18, 2007

(51) Int. Cl.
*E02D 29/02* (2006.01)

(52) U.S. Cl. ..... 405/262; 405/284

(58) Field of Classification Search ..... 405/262, 405/284–286, 302.4, 302.6, 302.7
See application file for complete search history.

(56) References Cited

U.S. PATENT DOCUMENTS

| | | | | |
|---|---|---|---|---|
| 3,686,873 | A | 8/1972 | Vidal | |
| 4,116,010 | A | 9/1978 | Vidal | |
| 4,343,572 | A | 8/1982 | Hilfiker | |
| 4,407,611 | A | 10/1983 | Murray et al. | |
| 4,710,062 | A * | 12/1987 | Vidal et al. | 405/262 |
| 4,834,584 | A * | 5/1989 | Hilfiker | 405/262 |
| 4,836,718 | A | 6/1989 | Deaton | |
| 4,993,879 | A * | 2/1991 | Hilfiker | 405/262 |
| 5,033,912 | A * | 7/1991 | Vidal | 405/262 |
| 5,169,266 | A | 12/1992 | Sala et al. | |
| 5,190,413 | A * | 3/1993 | Carey | 405/262 |
| 5,419,659 | A * | 5/1995 | Mercer | 405/302.7 |
| 5,525,014 | A | 6/1996 | Brown | |
| 5,797,706 | A * | 8/1998 | Segrestin et al. | 405/262 |
| 5,890,843 | A * | 4/1999 | Bastick et al. | 405/262 |
| 6,020,275 | A * | 2/2000 | Stevenson et al. | 442/60 |
| 6,050,746 | A * | 4/2000 | McCavour et al. | 405/124 |
| 6,315,499 | B1 * | 11/2001 | Kittson | 405/302.7 |

OTHER PUBLICATIONS

AK Steel Carbon Products (Jan. 2003), "Aluminized", pp. 1-2.*
AASHTO, "Interim Specifications Bridges"; 1994.
AASHTO T15 Technical Working Group, "MSE Retaining Wall Design Guidlines" (Draft) Mar. 1995.
AASHTO, "Standard Specifications for Highway Bridges", 2002.
AK Steel, "Aluminized Steel Type 2 Corrugated Steel Pipe", May 1999.
AK Steel, "Aluminized Steel Type 2 Corrugated Steel Pipe Durability Update: 1995", Feb. 1996.
FHWA Pub. No. FHWA RD-89-043, "Design and Construction Reinforced Soil Structures—vol. 1", Nov. 1989.
FHWA's Pub. No. FHWA NHI-00-043, "Mechanically Stabilized Earth Wall and Reinforced Slopes", Mar. 2001.
GDOT Special Research Study No. 8406, Feb. 1986.
Earth Reinforcement and Soil Structures, Jones, 1985.

* cited by examiner

*Primary Examiner*—Frederick L. Lagman

(57) ABSTRACT

A stabilizing element in a stabilized material particle structure, particularly an earthen embankment, wherein the material stabilizing elements that are inextensible (material with a higher modulus of elasticity than that of the surrounding particles) in composition nature but made more extensible because of its configuration. This extensibility gives the stabilizing elements the ability to mobilize more of the material shear resistance and adapt to current design standards under extensible type elements. The configuration also enhances the frictional engagement with the adjacent particles. The soil stabilizing elements are attached to facing elements and project into the compacted fill behind the facing. In some structures there may not be a facing element. Additionally, a material coating for metallic stabilizing elements that gives the elements improved corrosion protection, additional service life and/or expands the electrochemical environment in which they can be used.

16 Claims, 5 Drawing Sheets

STABILIZED EARTH STRUCTURE REINFORCING ELEMENTS

BACKGROUND OF THE INVENTION

1. Field of the Invention

The present invention relates generally to structures for supporting an underlying particle mass such as an earthen embankment or the like. The embankments may be materials other than soil or earth. This invention relates to the concepts of mechanically stabilized particle masses. The present invention relates to an improved construction for reinforcing elements used in forming retaining walls and earthen slopes. More particularly, the present invention may be described as a reinforced earthen structure wherein reinforcement is configured so as to utilize the earth friction and/or the passive resistance between the particles and the reinforcing element. The configuration also decreases the relative stiffness of the reinforcing element making the design of such structures require less applied load to the reinforcing member. In yet another aspect of the invention the structure is characterized by reinforcing members having an alloy coating to improve their resistance to corrosion and thus increase the useful life of the reinforced structure.

2. Background of the Invention

Retaining wall structures utilizing a plurality of individual facing elements are well known. Conventionally, such facing elements are connected to the underlying mass by means of tiebacks which generally take the form of straps of various material such as metals, glass, polymers, or of a webbed sheet of similar material. In the case of sloped earth masses the facing element may be omitted.

In U.S. Pat. No. 3,686,873, Vidal discloses a new constructional work now known as a mechanically stabilized earth structure. The referenced patent also disclosed methods for construction of mechanically stabilized earth structures such as retaining walls, embankment walls, platforms, foundations, etc. In a typical Vidal construction, particulate earthen material interacts with longitudinal elements such as elongated steel strips positioned at appropriately spaced intervals in the earthen material. The elements are generally arrayed for attachment to reinforced pre-cast concrete wall panels and, the combination forms a cohesive embankment and wall construction. The elements, which extend into the earthen works, interact with compacted soil particles principally by frictional interaction and thus act to mechanically stabilize the earthen work. The elements may also perform a tie-back or anchor function.

Various embodiments of the Vidal development have been commercially available under various trademarks including the trademarks, REINFORCED EARTH embankments and RETAINED EARTH embankments. Moreover, other constructional works of this general nature have been developed. By way of example, Hilfiker in U.S. Pat. No. 4,324,508 discloses a retaining wall comprised of elongated panel members with wire grid mats attached to the backside of the panel members projecting into an earthen mass. Vidal, Hilfiker and others generally disclose large precast, reinforced concrete wall panel members cooperative with strips, mats, etc. to provide a mechanically stabilized earth construction.

Vidal, Hilfiker and others also disclose or use various shapes of wall panel members. It is also noted that in Vidal and Hilfiker the elements interactive with the compacted earth or particulate behind the wall panels or blocks, are typically rigid steel strips or mats and rely upon friction and/or anchoring interaction, although ultimately all interaction between such elements and the earth or particulate is dependent upon friction.

Federal Highway Administration's Publication No. FHWA RD-89-043, 11/1989, has lead to the development of national design codes, such as AASHTO T15 Technical Working Group MSE Retaining Wall Design Guidelines (Draft), 3/95, the American Association of State Highway Official's Specification for Bridge Design, (1994-2001), and the Federal Highway Administration's Publication No. FHWA NHI-00-043. These codes consider the relative stiffness of the reinforcement element to the surrounding particles in assessing the total load in the element. The higher the relative stiffness the more load is applied to the element. For example, at this time it is considered that straight wire mesh has to carry 2.5 times the load as would a polymer reinforcement in the same structure. The obvious disadvantage of these new design codes is an increase in cost of the inextensible reinforcing members. There is therefore a great need to manufacture metallic reinforcement members that exhibit lower stiffness ratios than plain linear elements to reduce the cost.

U.S. Pat. No. 3,686,873 discloses elongated reinforcing elements which have a substantially uniform cross section. The adjacent particles to the elements engage the surfaces of the reinforcing elements with sufficient friction to prevent displacement of the reinforcement elements in the mass.

Attempts have been made to increase the restraining forces between the particles and the reinforcement elements. For example U.S. Pat. No. 4,116,010 shows a geometry that includes hot rolling plate steel with transverse ribs on both sides. These transverse ribs entrap the surrounding particles increasing the apparent frictional forces between the particles and the elements.

U.S. Pat. No. 4,343,572 indicates a zigzag geometry but only locates it adjacent the facing to allow for settlement and earthquake loads. There is no attempt to make the entire length zigzagged to make the element extensible in nature.

In *Earth Reinforcement and Soil Structures*, Jones shows the many ways different people have distorted the particle end of reinforcing element which act as abutments or anchors in the particulate. Simply anchoring the end of a reinforcing element makes the structure a totally different type of design and does not qualify as a reinforced earth structure nor does it behave in a manor that allows reduction of imposed design loads because of greater extensibility. In fact, as discussed in Federal Highway Administration's Publication No. FHWA NHI-00-043, 3/2001, it actually increases the predicted load in the reinforcing element. The devices disclosed in U.S. Pat. No. 4,407,611 fall into this category.

In U.S. Pat. No. 5,525,014, I disclose a method of making linear metallic reinforcement less stiff by placing a series of yielding connections along the entire length of the reinforcing element. This method of reducing the elements relative stiffness has proven to be relatively costly.

Another concern for the reinforcement element has been the design life expectancy. Metallic reinforcement is typically coated with zinc to give some additional life span to the elements. The previous mentioned design codes allow 16 years of additional life for this type of coating. In addition the surrounding material has to meet certain electrochemical properties to assure the predicted corrosion rates. Typically, this surrounding material has to be imported to the job from rock quarries at significantly more cost than using on site materials.

Metal materials instead of zinc coated carbon steel have been tried. Stainless steels featuring a chromium content were tried, but were unsuccessful (J. M. Jailloux, "Durability of Materials in Soil Reinforcement Application", 9th European Congress on Corrosion). Corrosion was localized significantly reducing the mechanical resistance of the reinforcing element unlike the generalized corrosion attack, as is normal with zinc coated carbon steel. Therefore the use of stainless steels was quickly abandoned.

In 1985 the Georgia Department of Transportation tried to use aluminum reinforcing elements to extend the life of one of its structures. In their Special Research Study No. 8405, "Reinforced Earth Wall Strip Serviceability Study", they show this was not successful.

U.S. Pat. No. 4,836,718 shows how to prolong the life of metallic elements by surrounding them with a cementous material, an effective but very costly method. In U.S. Pat. No. 5,169,266 Sala discloses another very expensive way to extend the design life of the reinforcing elements beyond that of the standard galvanizied steel.

For all the above reasons corrosion of reinforcement elements in such structures represents a considerable problem in terms of the requirements of soil characteristics, and/or the cost of the anti corrosion inclusions on the reinforcing element.

AK Steel has developed an economical aluminum coating for corrugated steel pipe that addresses all the corrosion issues previously described. The performance of this material is descibed in their literature, Aluminized Steel Type 2 Corrugated Steel, 5/1999 and Aluminized Steel Type 2 Corrugated Steel Pipe Durability Update: 1995, 2/1996. Although this technology has been available since 1952, it has not been obvious to apply this same technology to particulate mass reinforcing elements.

The present invention intends to use Aluminized Type 2 Corrugated Steel coatings on the reinforcing elements to increase life expectancy and/or allow for the use of fill material with a wider range of electro-chemical properties.

SUMMARY OF THE INVENTION

With the foregoing in mind, one principal object of the present invention is to provide an improved reinforcing element configuration for a stabilized earth structure that enables the element to develop more interaction with the fill material than the direct shear developed in linear elements. Another object of the invention is to provide a configuration for an earth stabilizing element that is capable of use with any type of inextensible reinforcing member. Yet another object of the invention is to provide geometric configuration for an earth stabilizing element which may be used to account for anticipated specific excessive loads in design of the structure. A further object of the invention is to provide a yielding geometry for an earth stabilizing element, which may be used to reduce the modulus of elasticity at any point along a reinforcing member. A still further object of the invention is to provide a yielding geometry for an earth stabilizing element which may be used to reclassify the inextensible reinforcing member as an extensible reinforcing member. Another object of the invention is to provide a reinforcing member for an earth stabilizing structure, which provides a means for accounting for horizontal loads in a cost-effective manner. Another object of the invention is to provide a reinforcing member for an earth stabilizing structure, which provides a means for designing as a more extensible material through use of a yielding configuration.

These and other objects of the present invention are accomplished through the use of elongated inextensible element that is then shaped into a non linear element so that axial tension is resisted by flex in the element instead of direct linear stress. The element is shaped so that it has a non-linear shape, such as a sine curve, series of zigzags, series of tangents and curves or a spiral in any plane. As the load is applied to the element the element elongates as a function of its configuration-material relationship and not just as the linear material would. This additional elasticity allows the fill material to develop more of its shear strength and reduces the load in the element had it not been configured so. Also, as the load is applied the configuration transfers the load into the surrounding fill by both friction and passive soil resistance, the passive resistance being a function of the geometry. After elongating the reinforcing element remains in a condition of safe stress.

Another principal object of the present invention is to provide an improved reinforcing element coating for a stabilized earth structure that enables the element to have a longer design life in the fill material than the currently used materials. Yet another object of this invention is to allow the reinforcing element to be used in fill material with a wider range of electro-chemical properties. A further advantage of this invention would be to allow the use of smaller cross sections in the elements for the same design life period.

One advantage of the present invention is that relatively high configurations can be used without having concern for the cantilever forces. Another advantage of the present invention is reduction in cost over the hot rolled section elements. Yet another advantage is the relatively high configurations means the reinforcing strips can be used rotated about their long axis in any plane, not depending directly on normal forces to develop frictional forces. These and other objects and advantages of the invention will become apparent from the following detailed description of the preferred embodiment of the invention in conjunction with the appended drawings.

BRIEF DESCRIPTION OF THE DRAWINGS

The foregoing objects and advantages of the present invention for a configured reinforcing material for an earth stabilizing structure will be more readily understood by one skilled in the art by referring to the following detailed description of a preferred embodiment and to the accompanying drawings which form a part of this disclosure. and wherein.

DESCRIPTION OF THE PREFERRED EMBODIMENT

Figure 1:
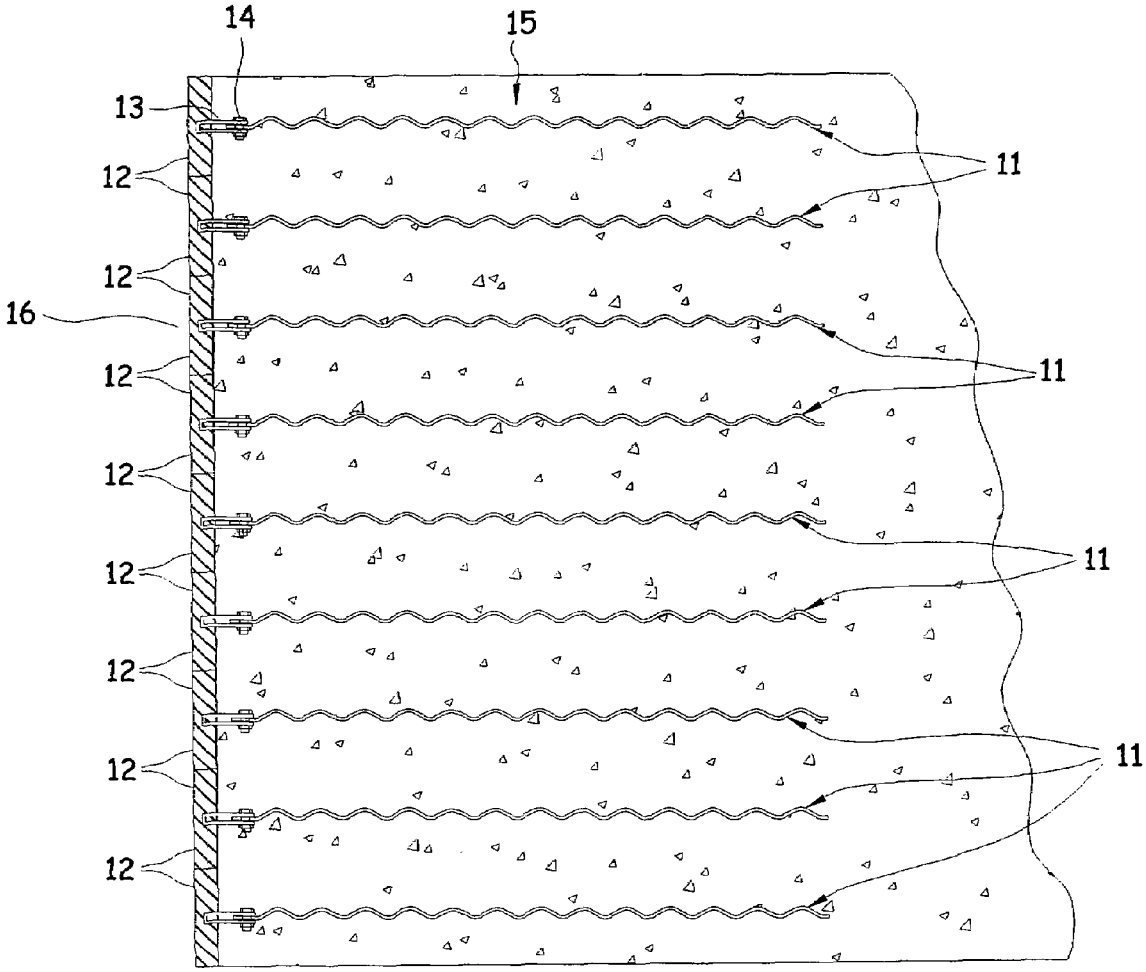
FIG. 1 is a sectional view of an earth stabilizing structure.

Referring to the FIGS. 1-10 for a clearer understanding of the invention, it may be seen that the preferred embodiment of the invention contemplates a non-linear stabilizing structure element. FIG. 1 shows a particle stabilizing structure. On the front of the structure is an earth retaining wall 16, formed by a plurality of facing elements 12. Behind the wall 16 is a mass of particulate fill material 15, which is stabilized by a plurality of horizontal reinforcing members 11 extending rearwardly from the facing elements 12 and embedded in the fill 15. The particles which make up the mass may include coal, clay, silt, sand, expanded shale, gravel, stones, glass or synthetic materials which may be used as a fill material. The configuration of the present invention may be used at any place along the reinforcing member, or may be used along the entire length of the member.

Figure 2:
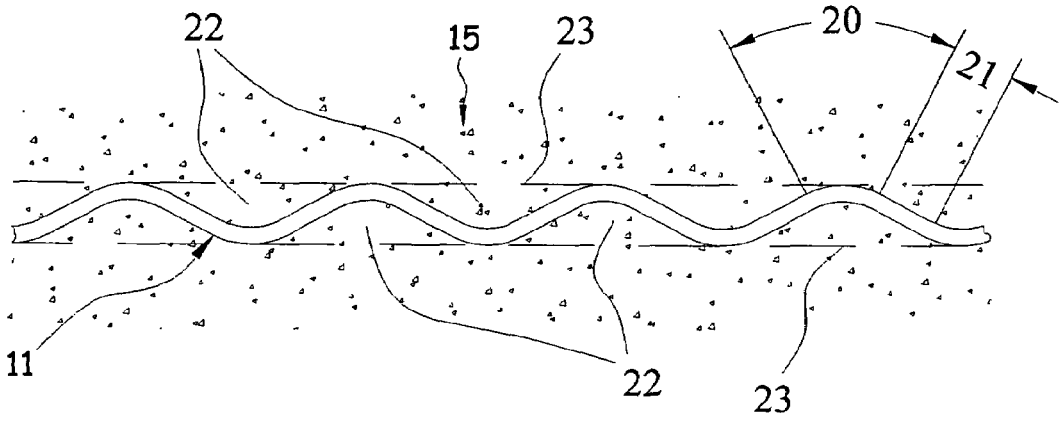
FIG. 2 is a sectional view of a portion of a reinforcing member showing the reinforcing member configured as a series of curves and tangents.

As shown in FIG. 2, the configuration of the reinforcing element 11 can be accomplished with a series of curves 20 and tangents 21. The curves are specifically shaped to allow the reinforcement element to develop more resistance with the particle material. The particle matter 22 between the crests is restrained in the load direction and becomes essentially integral with the reinforcement element. The friction force is increased because the apparent surface contact area is increased by the height of the configuration and the coefficient of friction between the particles and particles is higher than coefficient of friction between a flat reinforcing member and the particle fill.

Figure 3:
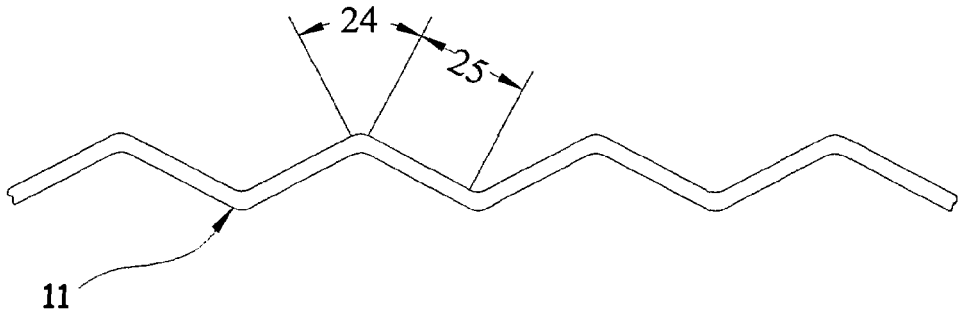
FIG. 3 is a sectional view of a portion of a reinforcing member showing the use of sharp bends and straight segments to from the desired configuration.
Figure 4:
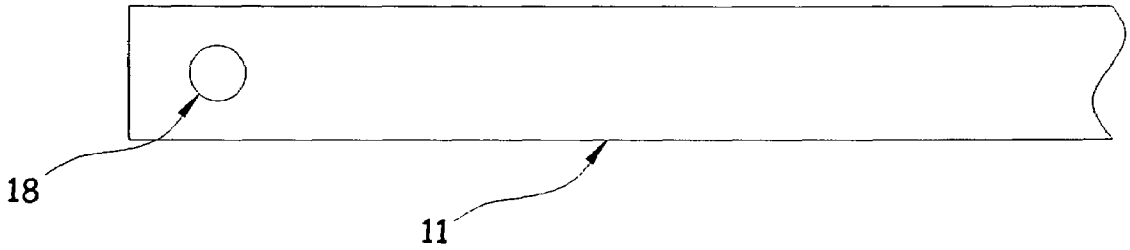
FIG. 4 is a top plan view of the reinforcing element of the present invention, shown in a flat plate and punched on one end with an attachment hole.

FIG. 3 illustrates the use of sharp bends 24 and straight segments 25 to accomplish the same interaction and advantages discussed in the previous paragraph. The area around this reinforcing member is filled with particles 15 (FIG. 2) but these particles have been omitted from FIG. 3 to simplify the drawing. FIG. 4 is a top plan view of the reinforcing member 11 of the present invention shown in a flat plate and punched on one end with an attachment hole 18.

Figure 5:
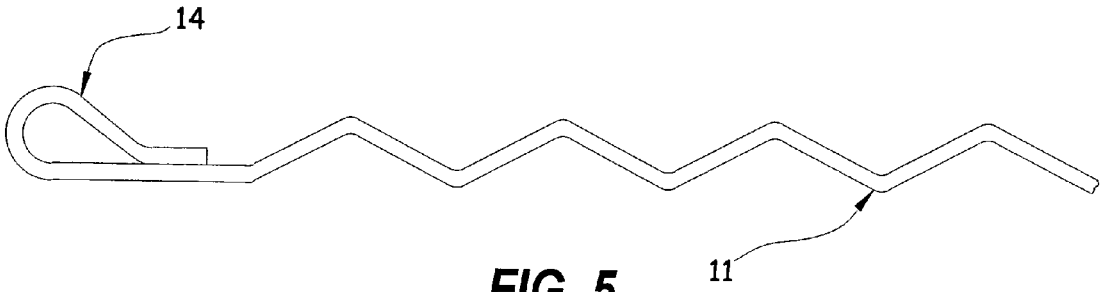
FIG. 5 is a view of the reinforcing element of the present invention, shown in rod material and looped on one end to form an attachment hole.
Figure 6:
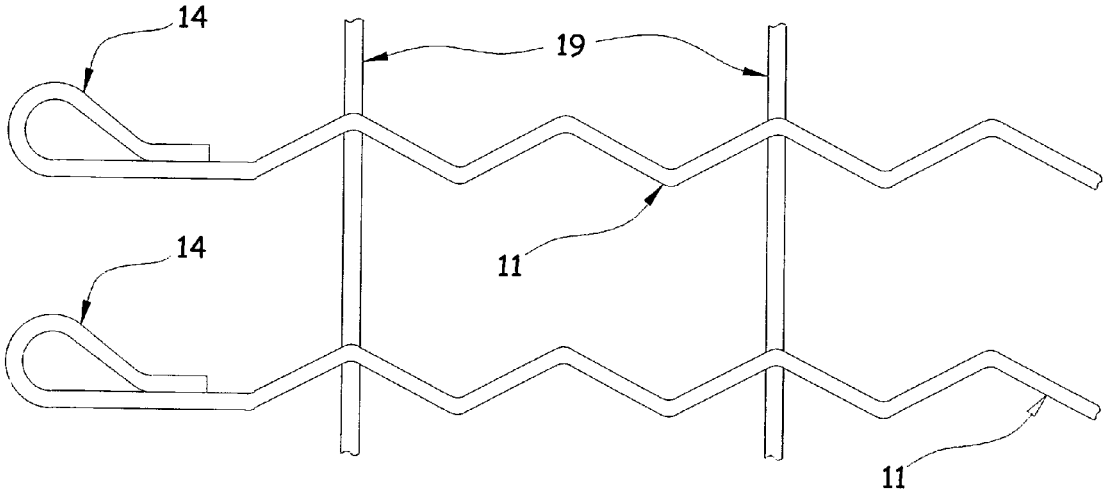
FIG. 6 is a top plan view of the reinforcing element of the present invention, shown in welded wire material and looped on the ends to form attachment holes.

FIG. 5 is a view of the reinforcing member 11 of the present invention, shown in rod material. In this case one end of the reinforcing element is looped to form an attachment hole 14. This element could be rotated about its long axis to any degree. FIG. 6 is a partial top plan view of the reinforcing member 11 of the present invention, shown in a welded wire mat. In this view the ends on one side of the mat are looped 14 for connecting. The mat is constructed by welding single reinforcing elements 11 onto transverse rods 19. The mat may have any number of reinforcing elements 11 or transverse rods 19. The reinforcing elements 11 in the mat may be constructed in any rotation about their long axis.

Figure 7:
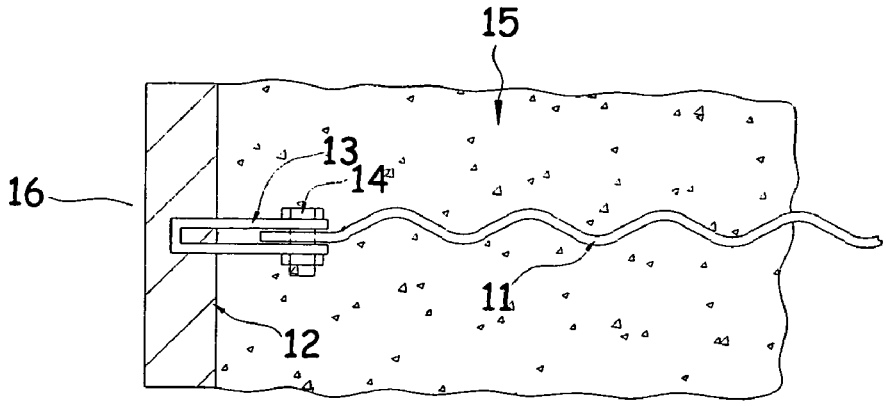
FIG. 7 is a sectional view of the present invention showing the reinforcing attached to the facing through the use of an attachment device extending outward from the facing.
Figure 8:
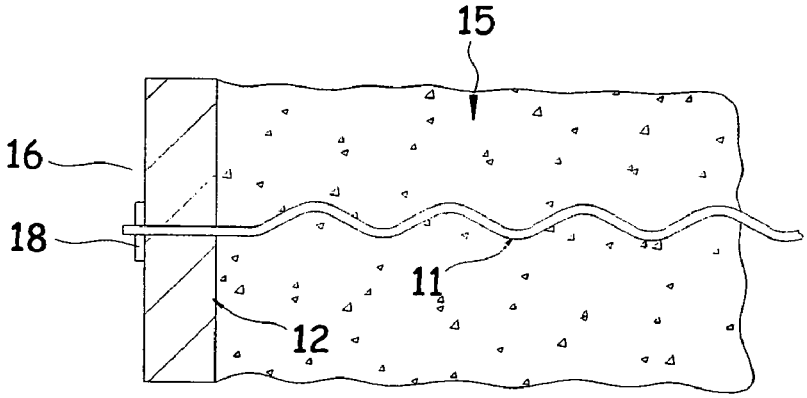
FIG. 8 is a sectional view of the present invention showing the reinforcing member extending through a facing element, and further showing a pin extending through a slot in the reinforcing element and along a surface of the facing element to form a connection.

FIG. 7 is a sectional view of the present invention showing the reinforcing member 11 attaching to a facing element 12 by means of an embedded connector 13. This connector protrudes rearwardly from the facing element 12 and has a pin or bolt 14 extending through the embedded connector 13 and through the reinforcing element 11 to form a connection. FIG. 8 is a sectional view of the present invention showing the reinforcing member 11 extending through a facing element 12. A pin or bolt 18 extends through the slot in the reinforcing member 11 and along a surface of the facing element 12 to form a connection.

Figure 9:
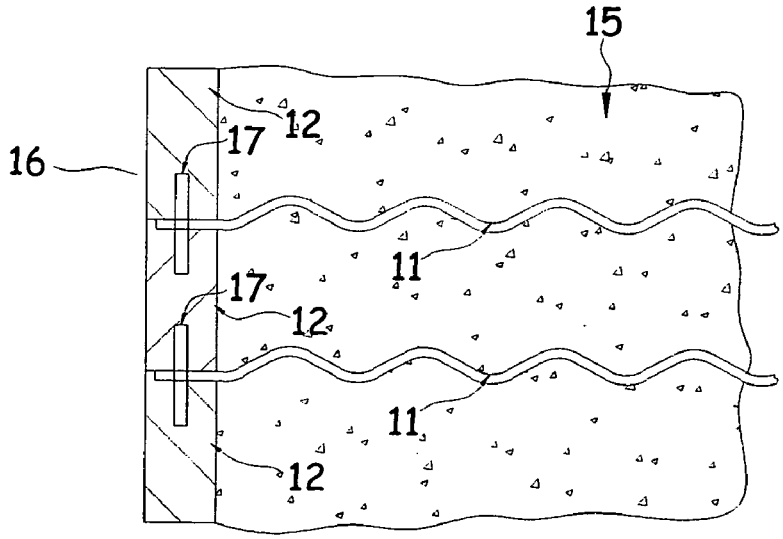
FIG. 9 is a sectional view of the present invention showing the reinforcing positioned between facing elements in a slot or grove and further showing a pin extending through the slot in the metal plate and into the adjacent facing elements to form a connection.
Figure 10:
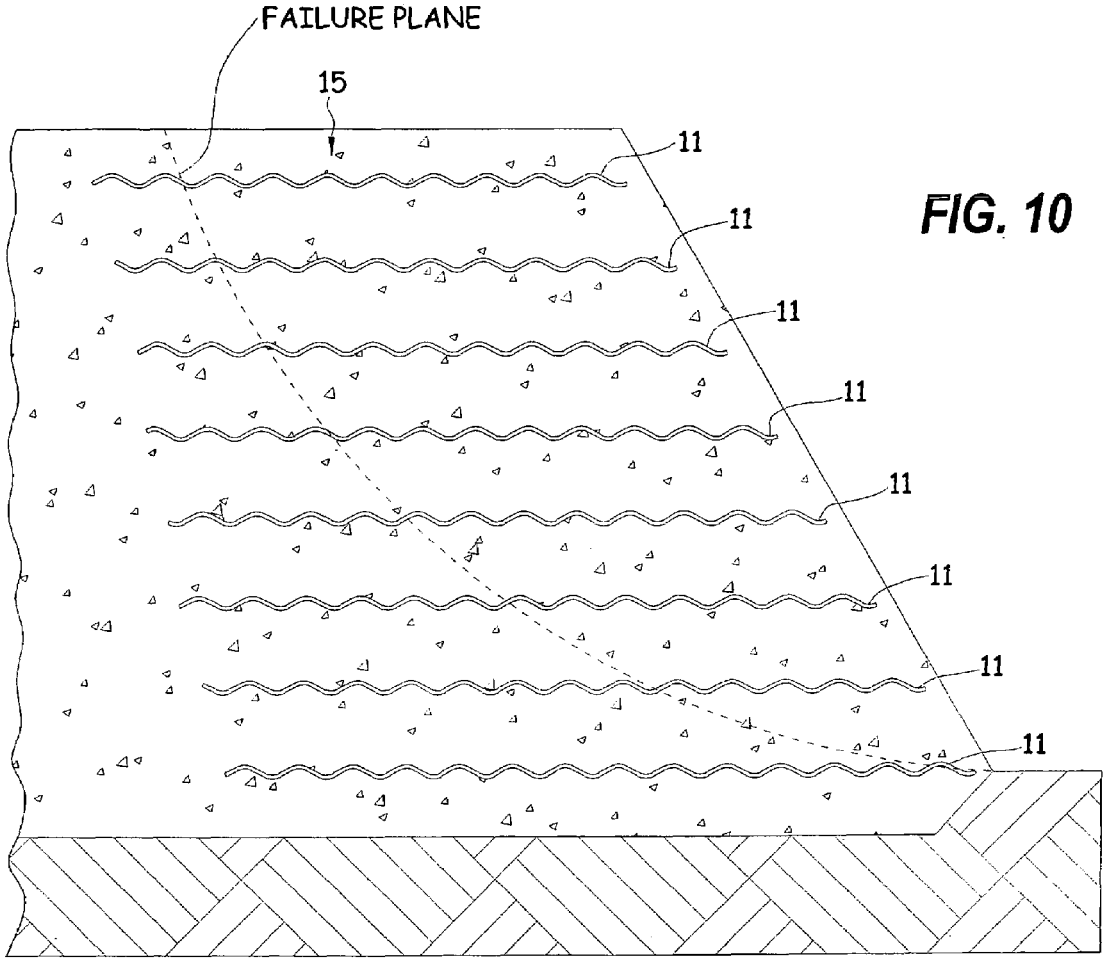
FIG. 10 is a sectional view of an over steepened slope without facing elements showing placement of the elastic configuration of the present invention on the reinforcing members along a potential failure plane. The dotted line represents the potential failure plane

FIG. 9 is a sectional view of the present invention showing the reinforcing element 11 positioned between facing elements 12. A pin 17 extending through the slot in the metal plate and into the adjacent facing elements 12 forms a connection. In some cases a stabilized earth structure is constructed without the use of facing elements. In the case of a over steepened slope, as shown in FIG. 10, the structure is stabilized by embedding horizontal reinforcing members 11 in layers in the particle fill material 15 of the structure. In such a structure there is at least one potential failure plane along which the reinforcement members are subjected to their highest loads. The dotted line represents one potential failure plane. The configuration of the present invention will allow the loads in this area to be calculated based on extensible theory rather than inextensible theory. This will predict less load in the reinforcing members and require less material in the individual reinforcing members.

While I have shown my invention in many variations, it will be obvious to those skilled in the art that it is not so limited but is to be understood that the forms of the invention shown are preferred embodiment thereof and that various changes and modifications may be made therein without departing from the spirit of the invention or scope as defined in the following claims.

What is claimed is:

1. A reinforcing member for use in a stabilized particle structure having at least one facing element with at least one said reinforcing member made from a substantially inextensible material extending rearwardly from said structure face, said structure including a mass of particles with a portion of said particles being in direct frictional contact with said reinforcing member, said reinforcing member configured by deforming a straight element having a substantially uniform cross section along its length such that said reinforcing member has a lower modulus of elasticity than an undeformed reinforcing member when longitudinally loaded, said deforming reducing the apparent modulus of elasticity enough to reduce the design stress in the element as calculated before the element was deformed.

2. A reinforcing member, as described in claim 1, formed by deforming a linear element having a substantially uniform cross section along its length, said deforming reducing the apparent modulus of elasticity enough to reduce the design stress in the element as calculated before the element was deformed.

3. A reinforcing member as described in claim 2, wherein said element is in a shape having a substantially uniform cross section along its length and selected from the group consisting of strip shaped, plate shaped or rod shaped.

4. A reinforcing member as defined in claim 2 wherein said element is deformed to a curved configuration along its length.

5. A reinforcing member as defined in claim 2 wherein said element is deformed to exhibit a plurality of offset segments along its length.

6. A reinforcing member as described in claim 1, wherein said reinforcement member is integral with said facing element.

7. A reinforcing member as described in claim 1, wherein said reinforcing member has one in end adapted for connection to said facing element.

8. A reinforcing member for use in a stabilized particle structure, said reinforcing member having a non-linear configuration and having a substantially uniform cross section over substantially the entire length thereof such that said reinforcing member has a lower modulus of elasticity than a linear reinforcing member when longitudinally loaded wherein said reinforcing member extends within an unfaced structure such that a portion of the particles in said stabilized particle structure are in direct frictional contact with said reinforcing member along substantially the entire length thereof, said deforming reducing the apparent modulus of elasticity enough to reduce the design stress in the element as calculated before the element was deformed.

9. A reinforcing member as defined in claim 8 and having an aluminized steel type 2 coating along its length.

10. A reinforcing member for use in a stabilized particle structure with said reinforcing member having an aluminized steel type 2 coating thereon to reduce the corrosion rate relative to the corrosion rate of galvanized material, said structure comprising at least one facing element and at least one reinforcing member extending rearwardly from said facing element, a portion of the particles in said structure being in direct frictional contact with said reinforcing member.

11. A reinforcing member for use in a stabilized particle structure wherein at least one reinforcing member extends rearwardly within an unfaced particle structure, a portion of the particles in said structure being in direct frictional contact with said reinforcing member, with said reinforcing member having an aluminized steel type 2 coating.

12. An improvement in stabilized particulate structures wherein said structure comprises a mass of particulate matter and wherein said improvement comprises at least one reinforcing member made from a substantially inextensible material having a substantially uniform cross section along its length extending within said mass of particulate matter and frictionally engaged by portions of said mass adjacent said at least one reinforcing member said member having a longitudinal dimension along which said reinforcing member is non-linear such that the modulus of elasticity of said member is increased relative to a linear member made from the same material, said deforming reducing the apparent modulus of elasticity enough to reduce the design stress in the element as calculated before the element was deformed.

13. The improvement as defined in claim 12 wherein said reinforcing member is defined by a series of offset portions extending along the length thereof.

14. The improvement as defined in claim 12 wherein said reinforcing member has a serpentine shape along its length.

15. The improvement as defined in claim 12 wherein said reinforcing member engages said adjacent portion of said mass intermediate non parallel segments of said reinforcing member.

16. The improvement as defined in claim 12 wherein said reinforcing member has a surface bearing an aluminized steel type 2 coating.

* * * * *